United States Patent [19]

Bergs

[11] 4,103,670

[45] Aug. 1, 1978

[54] FIREPLACE HEAT INTENSIFIER

[76] Inventor: Andrew Bergs, 3214 Clemenceau Blvd., Windsor, Ontario, Canada

[21] Appl. No.: 788,533

[22] Filed: Apr. 18, 1977

[51] Int. Cl.[2] ..... F24B 7/00

[52] U.S. Cl. ..... 126/121

[58] Field of Search ..... 126/121, 63

[56] References Cited

U.S. PATENT DOCUMENTS

| | | | |
|---|---|---|---|
| 4,010,729 | 3/1977 | Egli | 126/121 |
| 4,050,441 | 9/1977 | Horwinski | 126/165 |

FOREIGN PATENT DOCUMENTS

| | | | |
|---|---|---|---|
| 133,185 | 10/1919 | United Kingdom | 126/121 |

*Primary Examiner*—Edgar W. Geoghegan
*Attorney, Agent, or Firm*—Charles Krassov

[57] ABSTRACT

This invention consists of a device which is inserted into the top of a fireplace for the purpose of increasing its heating capacity. It consists of a "U" shaped tube of rectangular cross-section, having a flat rear section with diverging arms which bend outwardly at their ends. To the end of one arm is attached a casing containing a blower or fan which blows cold or room temperature air into said tube, wherein it is heated, and passed through the other arm which is equipped at its end with a louver. The blower and louver are interchangeable between the said arms. The U-shaped tube is provided with a plurality of diamond shaped and round ducts passing through it, so that the combustion products such as hot gases, flame, and smoke pass through their ducts towards the chimney, thus heating the air within the U-shaped tube, surrounding the said ducts. The tube is provided with means for its attachment to the fireplace, and with permanent and removable baffles for directing the hot combustion products in the fireplace towards said tube.

3 Claims, 5 Drawing Figures

FIREPLACE HEAT INTENSIFIER

This invention relates generally to devices used in increasing the heat capacity of fireplaces, and particularly to such heating device which can be built into a fireplace during its construction, or installed into an existing fireplace.

The primary object of this invention is to provide such a device which can be inserted into an existing fireplace to enable it to cope with unusual cold weather periods and at the same time reduce the quantity of fuel necessary to maintain comfortable temperatures, as well as reducing the quantity of fuel required to heat a home or place of business at normal seasonal temperatures.

In describing the invention reference will be made to the attached drawings in which—

Figure 1:
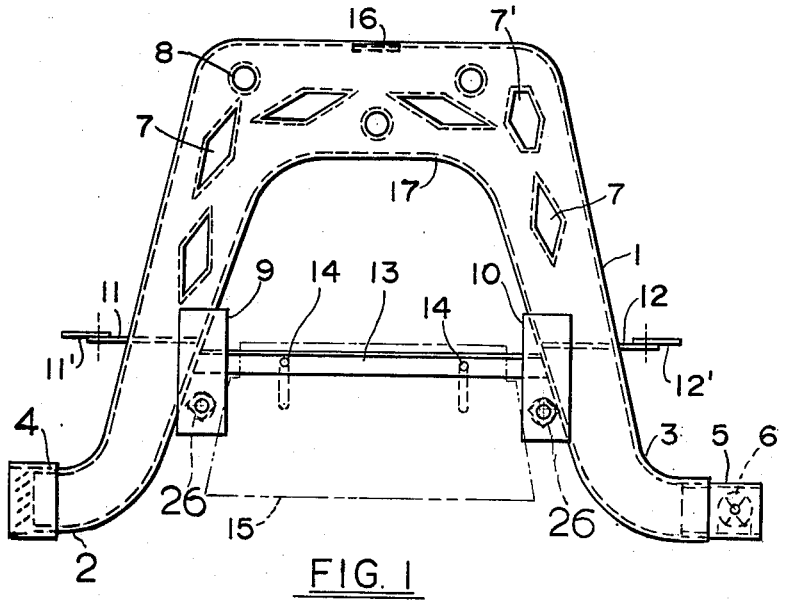
FIG. 1, is a plan view of the invention.
Figure 2:
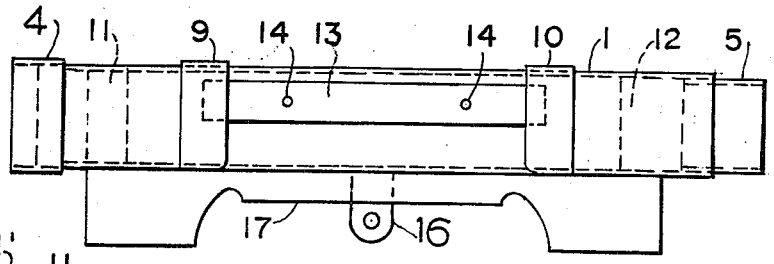
FIG. 2, is a front view of the invention.

In the drawings, the invention is shown consisting of a U-shaped tube 1 of a rectangular cross-section, having a somewhat flat rear section and two diverging arms 2 and 3 whose ends are curved outwardly. To the curved end of the arm 3 is attached a casing 5, containing a fan or blower 6 which takes in the air from the room in which the fireplace is located, sends it through the U-shaped tube, and is discharged from the end of the arm 2, to which is attached a louvered outlet 4. The blower casing 5 and the louvered outlet 4 are attached to the arms by sliding over or inside of the arm ends, as shown in FIG. 1, so that they may be easily interchangeable.

The U-shaped tube 1 is provided at the rear thereof and partly up the arms 2 and 3 with several spaced diamond shaped and circular ducts 7 and 8, respectively, which are left open on the surface and underside of the U-shaped tube 1, so that combustion products such as hot gases, flame, and smoke can pass through these ducts on the way to the chimney.

Figure 4:
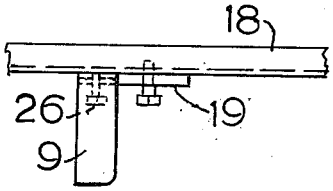
FIG. 4, shows a detail of another component of the invention.

A supporting plate 9 is provided to the arm 2, and a similar plate 10 is attached to the arm 3. These plates are used as a means for attaching the U-shaped tube 1 to the lintel angles of the fireplace 22. A suggested method of attachment is shown in FIG. 4, where a notched clamp 19 supports the tube 1 by means of the supporting plates 9 and 10. The clamp 19 fits under the tops of the plates 9 and 10, and is bolted to the fireplace lintel 18. One or two bolts 26 are provided in the tops of plates 9 and 10, by means of which the device is levelled and locked to the fireplace.

Figure 3:
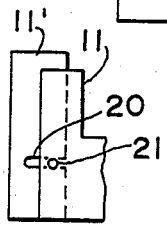
FIG. 3, shows a detail of one of the invention components.

A baffle plate 11 is attached to the arm 2, and a similar plate 12 is attached to the arm 3. These plates are attached to the outer wall and underside of the arms, so that when the invention is inserted into the fireplace, the baffles 11 and 12 enclose the space between the arms 2 and 3 and the vertical walls of the fireplace. In the case where the baffles 11 and 12 are too narrow to enclose said space entirely, an extension 11' and 12' is provided to plates 11 and 12, respectively. The plates 11' and 12' are provided with slots 20 so that they can slide upon a bolt 21 in the fixed baffles 11 and 12, and be held by it, as shown in FIG. 3.

A narrow baffle 17 runs along the rear inside bottom of the tube 1, and extends along inner bottom edge of the arms 2 and 3, until it joins the baffles 11 and 12. A sloping narrow plate 13 joins the inside walls of the arms 2 and 3 and is used for attaching thereto a smoke escape baffle 15. Two spaced bolt holes 14,14, with contained bolts are provided in the plate 13, for attaching the baffle 15. The baffle 15 is shown in broken line to indicate that it is not a permanent feature of the invention, but that it can be used in fireplaces which normally smoke due to natural or structural conditions characteristic of some fireplaces.

Figure 5:
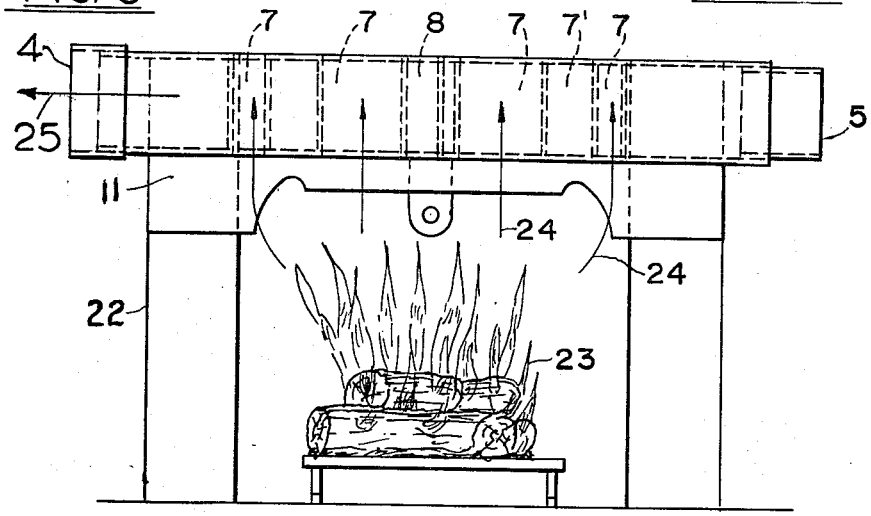
FIG. 5, shows a diagram of the invention installed in a fireplace.

In FIG. 5, the invention is shown installed in a fireplace 22. The fire 23 which is intended to heat the room or rooms in which the fireplace is located, and the hot combustion products created by said fire, rise and pass through the ducts 7 and 8 as shown by arrows 24, thereby heating the air which passes through the tube 1 and surrounds the ducts 7 and 8. The heated air in the duct 1 is discharged into the room through the arm 2 as shown by the arrow 25, and adds to the heat normally discharged through the open face of the fireplace.

An additional bracket with a bolt 16 is centrally located at the bottom rear of the tube 1 for additional attachment of the invention to the interior of the fireplace when required.

Preliminary tests under variable conditions, have shown an increase in heating efficiency, by the use of this invention ranging between 35 and 50%.

Having described my invention, what I claim is:

1. A heat intensifier insert into a fireplace comprising a U-shaped tube of rectangular cross-section having a somewhat straight rear section with a diverging arm extending from each end thereof, said arms terminating in short outwardly curved ends; a plurality of open end ducts located inside and in the rear and part way up the arms of said tube, said open duct ends terminating at the top and bottom of said tube; a casing containing a fan or blower therein for attaching to the end of one of said arms by tightly sliding part way into said arm; a louver attached to the end of the other arm of said tube by tightly sliding over said arm; said blower contained casing and said louver being interchangeable with respect to the arms to which they are attached; an extendable baffle located at each side of said tube for the purpose of enclosing any space between the tube and the opening of the fireplace into which it is inserted; a plate bent into an angle attached to each of said arms, the horizontal leg of which is flush with the top of said arm and extending outwardly to the inside of the "U," by means of which the said tube can be attached to said fireplace; a narrow baffle attached to the rear inside bottom edge of the tube and running part way along each arm to make contact with each of said extendable side baffles; and a narrow plate joining the insides of the two arms, for attaching thereto a comparatively wide baffle for preventing the escape of smoke from the fireplace into the room, when required.

2. In a fireplace insert such as described in claim 1, in which the said side baffles are provided with attached but sliding plates for the purpose of increasing the width of said baffles when required in oversized fireplace openings.

3. A fireplace insert such as described in claim 1, provided with a flat plate baffle with vertically spaced slots therein for attaching to said plate which joins the inside of said arms, for the prevention of smoke escaping through the open face of the fireplace.

* * * * *